US005641279A

United States Patent [19]

Yamamoto

[11] Patent Number: 5,641,279

[45] Date of Patent: Jun. 24, 1997

[54] SWING TYPE ROTARY COMPRESSORS HAVING A CUT-OFF PORTION ON THE ROLLER

[75] Inventor: Yasushi Yamamoto, Kusatsu, Japan

[73] Assignee: Daikin Industries, Ltd., Osaka, Japan

[21] Appl. No.: 500,846

[22] PCT Filed: Dec. 1, 1994

[86] PCT No.: PCT/JP94/02018

§ 371 Date: Aug. 4, 1995

§ 102(e) Date: Aug. 4, 1995

[87] PCT Pub. No.: WO95/16135

PCT Pub. Date: Jun. 15, 1995

[30] Foreign Application Priority Data

Dec. 6, 1993 [JP] Japan ..... 5-305247

[51] Int. Cl.[6] ..... F04C 18/356; F04C 29/08

[52] U.S. Cl. ..... 418/66

[58] Field of Search ..... 418/64, 66, 67

[56] References Cited

FOREIGN PATENT DOCUMENTS

| | | |
|---|---|---|
| 48-113011 | 3/1972 | Japan . |
| 54-29403 | 8/1977 | Japan . |
| 58-70089 | 4/1983 | Japan . |
| 63-9487 | 1/1988 | Japan . |
| 5202874 | 8/1993 | Japan . |
| 5248380 | 9/1993 | Japan . |
| 5306691 | 11/1993 | Japan . |
| 5312169 | 11/1993 | Japan . |
| 7126 | of 1914 | United Kingdom ..... 418/66 |

*Primary Examiner*—John J. Vrablik

*Attorney, Agent, or Firm*—Birch, Stewart, Kolasch & Birch, LLP

[57] ABSTRACT

In a swing type rotary compressor, a roller (2) is fitted on an eccentric portion (31) of a drive shaft (3) and installed within a cylinder chamber (11) so as to be able to orbit. On the roller (2), a blade (21) partitioning the cylinder chamber (11) into a compression chamber (X) and a suction chamber (Y) to which a suction port (13) is opened is integrally protruded. On the cylinder (1), a support body (4) swingably supporting the blade (21) is swingably supported. On an outer circumferential surface of the roller (2), a cutoff portion (22) extending forward in a rotation direction from near a blade protruding position on the roller (2) and shifting a suction shut-off point for suction gas sucked from the suction port (13) toward a side of the compression chamber (X) is formed on a side of the suction chamber (Y) with respect to the blade protruding position. With the configuration, only by forming the cut-off portion with a simple cutting operation applied on an outer circumference of the roller (2), suction resistance in sucking suction gas into the suction chamber (Y) and passage resistance in supplying suction gas from the compression chamber (X) to the suction chamber (Y) via the cut-off portion (22) are reduced and thus, its compression capacity can be exactly adjusted. Furthermore, its manufacturing cost can be reduced by sharing various parts in common.

12 Claims, 4 Drawing Sheets

SWING TYPE ROTARY COMPRESSORS HAVING A CUT-OFF PORTION ON THE ROLLER

TECHNICAL FIELD

The present invention relates to a swing type rotary compressor primarily employed in a refrigeration apparatus.

BACKGROUND ART

Generally, rotary compressors are set to different predetermined compression capacities depending on models, and in order to reduce their cost as low as possible, capacities thereof are adjusted by changing an eccentricity amount of a drive shaft and an outer diameter of a roller without changing a shape of a cylinder of the compressor. In this case, however, while the cylinder can be made common between different models, the control of parts becomes complicated because the kinds of drive shafts and rollers increase in number. In addition, there has been such a problem that changes in their production line and changes in centering become necessary, resulting in cost increase.

Furthermore, while there is known an inverter controlled type rotary compressor which is made variable in its compression capacity by control of the number of revolutions to achieve the use of the same of parts, because such an inverter-controlled compressor is very expensive, a refrigeration apparatus incorporating such a compressor becomes very expensive in manufacturing cost.

As a result, as another means for adjusting the compression capacity of the rotary compressor, there is conventionally known, as described in Japanese Utility Model Application Laid-Open Publication No. 54-29403, a method constituted so that a thin plate is inserted between a cylinder and a front head or a rear head, a bypass passage communicating, at starting time of suction, a suction chamber in which a suction port of the cylinder opens with a compression chamber in which a discharge port opens is formed on said thin plate and the compression capacity is adjusted by shifting a suction shut-off position of suction gas toward the compression chamber side.

Namely, said capacity adjustment method is constructed as follows. As shown in FIG. 6, in a rotary compressor wherein, in a cylinder chamber A1 of a cylinder A arranged between a front head and a rear head, a roller B is internally installed with an eccentric portion C1 of a drive shaft C being fitted on said roller B, and on an intermediate position between a discharge port A2 and a suction port A3 formed on said cylinder A. A blade D divides an inner space of said cylinder chamber A1 into a compression chamber X communicating with said discharge port A2 and a suction chamber Y communicating with said suction port A3 and the blade D reciprocably mounted. A rear end of said blade D is urged by a spring D1 so as to contact a tip end thereof with an outer circumference of said roller B at all times. A circular thin plate E having the same diameter as that of said cylinder A and having a shaft hole E2 pierced by said drive shaft C at the center thereof is inserted between said front head and said cylinder A. A bypass passage E1 shifting the suction shut-off position of suction gas sucked from said suction port A3 into said suction chamber Y toward said compression chamber X side is formed on this thin plate E. Said bypass passage E1 is formed in a long circular arc shape along an inner wall of said cylinder chamber A1 and said bypass passage E1 is formed through the thickness of said thin plate E.

Accordingly, with said configuration, the internal space of said cylinder chamber A1 is partitioned, by the blade D and a contact point O in which the outer circumference of said roller B is brought into contact with the inner wall face of said cylinder chamber A1, into a suction chamber Y formed between the contact point O and a wall face of the blade D in the forward side of the rotation direction of said eccentric shaft portion C1 and a compression chamber X formed between said contact point O and a wall face of the blade D in the backward side of the rotation direction of said eccentric shaft portion C1. When driving the drive shaft C, said contact point O of the roller B with the inner wall of said cylinder chamber A1 is moved along the inner wall of said cylinder chamber A1 and gas is sucked into said suction chamber Y from said suction port A3 and compressed in said compression chamber X to be discharged from said discharge port A2, and thus, the suction and compression of gas is repeated. In addition, because said thin plate E is inserted between said cylinder A and front head, when said contact point O is positioned at the bypass passage E1 formed on said thin plate E, said compression chamber X and said suction chamber Y are communicated with each other and the gas within said compression chamber X is not compressed. First when said contact point 0 has passed the bypass passage El, suction of suction gas is shut off and the suction chamber Y and compression chamber X are partitioned in a hermetically sealed state, and thus the compression of gas in the compression chamber X is started. Therefore, by shifting the shut-off position of suction gas to the compression chamber by an arbitrary amount toward the compression chamber X side through changing the length of said bypass passage El, the start time-point of gas compression in the compression chamber X is adjusted and thus, the compression volume in the compression chamber X can be adjusted. In other words, the compression capacity in said compression chamber X becomes controllable arbitrarily and the variation in the capacity of said rotary compressor is enlarged.

However, in said configuration, because a thin plate provided with said bypass passage E1 is required separately, the number of parts is increased and assembly man-hours thereof are increased that much, resulting in complication of the over-all construction. In addition, because said bypass passage E1 has only the passage area corresponding to the thickness of said thin plate E inserted between said cylinder A and front head, not only it is necessary to guide suction gas sucked into the suction chamber Y from said suction port A3 to an axial direction end side of said cylinder A where said thin plate E is arranged but also the resistance when the suction gas within said suction chamber Y passes through said bypass passage E1 is increased, resulting in the problem that an exact control of the compression capacity becomes difficult.

DISCLOSURE OF THE INVENTION

The present invention has been developed by focusing the fact that, in a swing type rotary compressor wherein a blade partitioning a cylinder chamber of a cylinder into a compression chamber and a suction chamber is formed integrally with a roller arranged in said cylinder chamber, said roller is revolution-driven without rotating in said cylinder chamber and a circumferential position of said roller facing its suction port is not greatly shifted relative to said suction port. The object of the present invention is to provide a swing type rotary compressor which is able to exactly adjust its compression capacity, while reducing the resistance in by-passing suction gas only by applying a simple cutting operation, etc. on an outer circumference of said roller and to reduce the manufacturing cost through commonness of various parts without raising the complication of parts control.

In order to achieve the above-described object, a swing type rotary compressor of the present invention is characterized by comprising a cylinder having a cylinder chamber inside said cylinder;

a roller fitted on an eccentric portion of a drive shaft and installed in said cylinder chamber so as to be able to revolve;

a blade integrally formed on said roller so as to protrude therefrom and partitioning said cylinder chamber into a compression chamber and a suction chamber to which a suction port is opened;

a support body swingably supported on said cylinder and swingably supporting said blade; and a cut-off portion formed on an outer circumference of said roller of a side of the suction chamber with respect to a protruding position from which the blade protrudes and extending from the vicinity of the protruding position forward in a revolution direction so as to shift a suction shut-off position for suction gas sucked from said suction port toward a side of the compression chamber.

In the swing type rotary compressor constructed as described above, because the cut-off portion extending in the revolution direction from near the protruding position of the roller and shifting the suction shut-off position on the suction chamber toward the compression chamber side is formed on the outer circumference of the roller, while the cut-off portion of the roller is adjacently confronted with the inner wall face of the cylinder chamber, the compression chamber and the suction chamber are communicated with each other through the cut-off portion. Therefore, gas compression within the compression chamber is not started even when the roller is revolution-driven by the drive of the drive shaft. First when the outer circumferential surface ahead of the cut-off portion in the revolution direction contacts the inner wall face of the cylinder chamber, the compression chamber is hermetically partitioned from the suction chamber and the gas compression is started within the compression chamber.

Because the roller integrally protruding the blade is revolution-driven in the cylinder chamber, only by forming on the outer circumference of the roller the cut-off portion arbitrarily in a circumferential length, the suction shut-off position of suction gas on the compression chamber is arbitrarily shifted toward the compression chamber side, that is, to the forward side in the revolution direction of the roller from the opening of the suction port and thus, the compression volume in the compression chamber can be adjusted by adjusting the starting time of gas compression in the compression chamber, and the variation in the capacity of the swing type rotary compressor can be enlarged.

In addition, only by forming the cut-off portion in an arbitrary depth, the suction resistance at suction of suction gas can be reduced with a space formed by the cut-off portion, and a simple and exact adjustment of compression capacity of the rotary compressor can be made while reducing a passage resistance in passing through the cut-off portion. Furthermore, in effecting the adjustment of the compression capacity, parts other than the roller can be used as common parts, and consequently, the manufacturing cost can be reduced through the commonness of various parts without raising the complication of parts control.

In an embodiment of the present invention, a concave portion for guiding the suction gas introduced from the suction port to the suction chamber side is formed at a position of the cut-off portion confronting the suction port. In this case, the space near the opening of the suction port at the start of suction can be enlarged by the concave portion and the suction gas from the suction port can be smoothly guided to the forward side of the suction chamber in the revolution direction. Accordingly, with the suction gas being introduced with that much less suction resistance and more smoothness, the suction chamber is communicated to the compression chamber through the cut-off portion, and thus, the compression capacity of the compressor can be adjusted correctly.

When the cut-off portion is provided on the roller over the entire axial length thereof and both axial ends thereof are opened to the axial end faces of the roller, the cut-off portion can be simply formed with an end mill and so on. Furthermore, even when the suction port is formed in any axial position of the cylinder or on the front head or rear head, the suction port can be opened to the cut-off portion. As a result, the suction resistance from the suction port to the suction chamber can be reduced and with passage resistance from the suction chamber to the compression chamber being held low, the compression capacity can be exactly adjusted.

Furthermore, the cut-off portion can be formed on an intermediate portion in the axial length of the roller so as to be closed to the axial end portions of the roller. Particularly in the case of forming the suction port in the cylinder, because the suction port is generally formed in an axially intermediate portion of the cylinder, the cut-off portion is confronted with the opening of the suction port and thus, the suction gas resistance to the cut-off portion can be reduced, and by forming the cut-off portion closed to both axial ends of the roller, a predetermined thickness can be obtained at both axial end faces of the roller. Therefore, as compared with the case of forming the cut-off portion over the entire axial length of the roller so as to be opened to axial both end faces of the roller, a predetermined thickness can be secured on axial end faces of the roller and thus, leakage of high pressure oil and refrigerant through the clearances between axial both end faces of the roller and the respective heads can be suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS OF THE INVENTION

Figure 1:
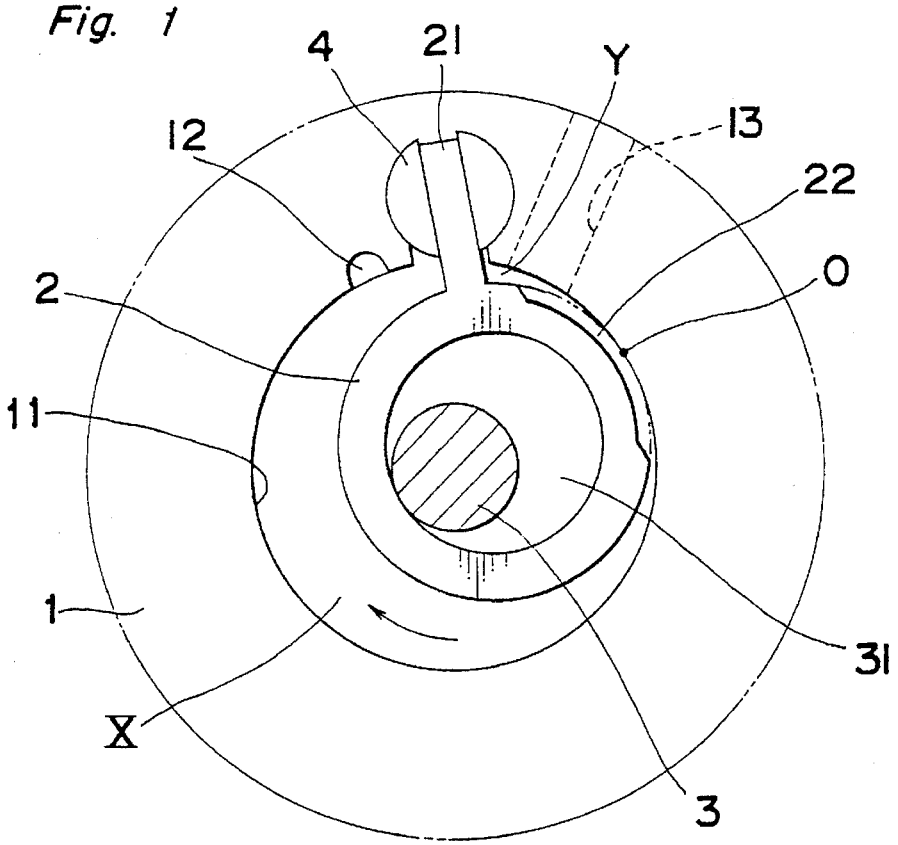
FIG. 1 is a plan view showing an essential portion of a swing type rotary compressor according to a first embodiment of the present invention.

FIG. 1 shows an essential part of a swing type rotary compressor according to the present invention. In the rotary compressor, a roller 2 is provided in a cylinder chamber 11 of a cylinder 1 inserted between a front head and a rear head. An eccentric portion 31 of a drive shaft 3 is fitted in the roller 2, so that the roller 2 is revolved in a direction indicated by an arrow while an outer circumference of the roller is in contact with the inner wall face of the cylinder chamber 11 according to the rotation of the drive shaft 3. Furthermore, the outer circumference of the roller 2 is integrally provided with a blade 21 protruding outward in an radial direction therefrom. A support body 4 is rotatably provided at an intermediate position between a discharge port 12 and a suction port 13 provided on the cylinder 1 so that the blade 21 is supported on the support body 4 so as to be swingable and movable back and forth.

By partitioning the cylinder chamber 11 into a suction chamber Y communicating with the suction port 13 and a compression chamber X communicating with the discharge port 12 with the blade 21 protruded from the roller 2 and by moving the outer circumference of the roller 2 along the inner wall face of the cylinder chamber 11 in contact therewith according to the rotation of the drive shaft 3, gas is sucked into the suction chamber Y from the suction port 13 and compressed in the compression chamber X so as to be discharged from the discharge port 12, and thus, gas suction and compression is repeated.

In the above-described configuration, firstly a first embodiment of the present invention is described below with reference to FIGS. 1 and 2. In the first embodiment, a cut-off portion 22 extending from near a base portion of the roller 2 from which the blade 21 protrudes forward in a revolution direction of the roller and shifting a suction shut-off position for suction gas sucked to the side of the suction chamber Y from the suction port 13 toward the compression chamber X side, that is, the forward side in the revolution direction of the roller 2 is formed on the suction chamber Y side of the outer circumference of the roller 2.

Figure 2:
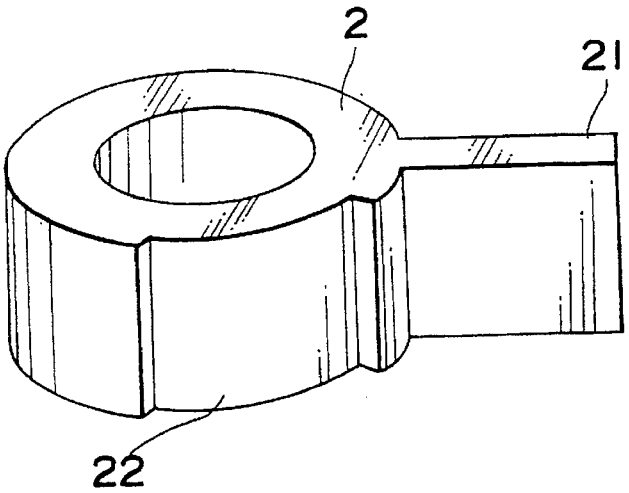
FIG. 2 is a perspective view showing a roller of the first embodiment.

In other words, the cut-off portion 22 is formed, as shown in FIGS. 1 and 2, so as to extend by a predetermined length in the circumferential direction from a position on the circumference confronting the suction port 13 toward the forward side in the revolution direction of the roller 2. Further, the cut-off portion is formed over an entire axial length of the roller and both ends of the cut-off portion 22 in the axial direction are opened to both axial end faces of the roller 2.

With the above-described configuration, when a contact point of the outer circumference of the roller 2 (in the cut-off portion 22, a chain line in FIG. 1) with the inner wall of the cylinder chamber 11 is designated with O, in the case where the contact point O is positioned, as shown in FIG. 1,in the range of the cut-off portion 22, the suction chamber Y and the compression chamber X are communicated to each other via the cut-off portion 22. As a result, the gas in the compression chamber X flows to the suction chamber Y, and the gas compression in the compression chamber X is not started. First, when the contact point O is shifted forward in the revolution direction of the roller 2 so as to bring the outer circumferential face of the roller on the forward side of the cut-off portion in the revolution direction into contact with the inner wall of the cylinder chamber 11, the compression chamber X becomes closed hermetically to the suction chamber Y and the gas compression within the compression chamber X is started.

Because the present embodiment is a swing type rotary compressor employing the roller 2 with a protruding blade 21 integrally provided thereon, the roller 2 is orbited within the cylinder chamber 11 and thus, only by forming the cut-off portion 22 on the roller 2 with its circumferential length being set at will, the suction shut-off point of the compression chamber X for the suction gas in the suction chamber Y can be shifted at will toward the compression chamber X side, that is, forward in the revolution direction of the roller 2 with respect to the opening of the suction port 13. Therefore, the start timing of gas compression within the compression chamber X can be adjusted so as to adjust the compression volume of the compression chamber X. Namely, the compression capacity in the compression chamber X becomes adjustable at will and the variation in the capacity of the swing type rotary compressor can be enlarged.

Furthermore, because the cut-off portion 22 can be formed in an arbitrary depth on the outer circumference of the roller 22, by confronting the cut-off portion 22 with the suction port 13 and forming a space on the cut-off portion 22, the suction resistance at suction of suction gas can be reduced and the passage resistance can be reduced when suction gas passes through the cut-off portion 22, while the adjustments of compression capacity can be made exactly and simply. In addition, because parts such as the cylinder 1 and drive shaft 3 other than the roller 2 formed with the cut-off portion 22 can be used as common parts, the manufacturing cost can be reduced through the commonness of parts without raising the complication of parts management.

Furthermore, when the cut-off portion 22 is formed, as shown in FIGS. 1 and 2, over the entire axial length of the roller 2 with both axial ends thereof being opened to the both axial end faces of the roller 2, the cut-off portion can be simply formed such as by an end mill. Furthermore, even when the suction port 13 is formed in any axial position of the cylinder 1 or on the front head or rear head, the suction port 13 can be opened toward the cut-off portion 22. As a result, the suction resistance from the suction port 13 to the suction chamber Y can be reduced and the passage resistance from the suction chamber Y to the compression chamber X can be reduced, while the compression capacity can be exactly adjusted.

Figure 3:
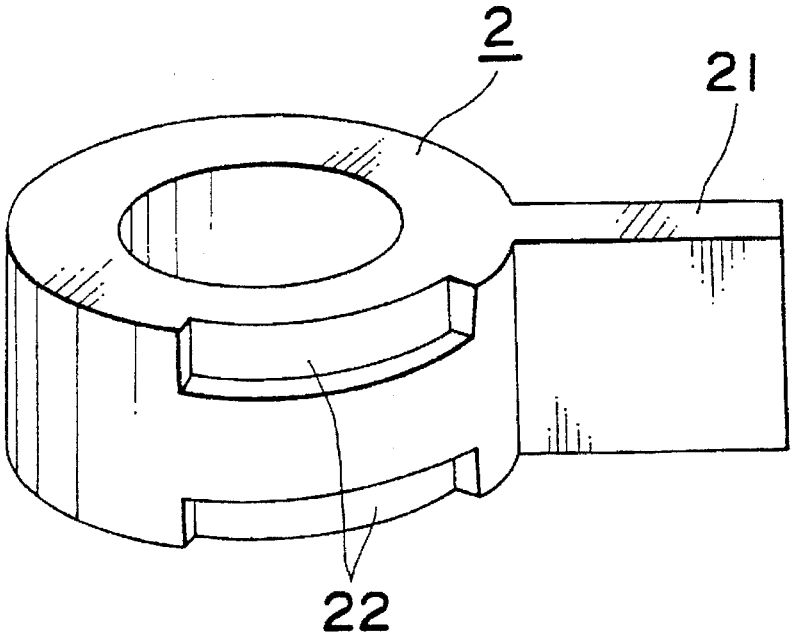
FIG. 3 is a perspective view showing a roller in a second embodiment.

Furthermore, as in a second embodiment shown in FIG. 3, cut-off portions 22 may be formed respectively only on axially end portions of the roller 2. Such configuration is particularly effective for the case where a suction port 13 is provided respectively on the front and rear head arranged on both side of the cylinder 1, and the suction gas introduced is from the suction port 13 can be guided with less suction resistance and the compression capacity control can be made exactly.

Figure 4:
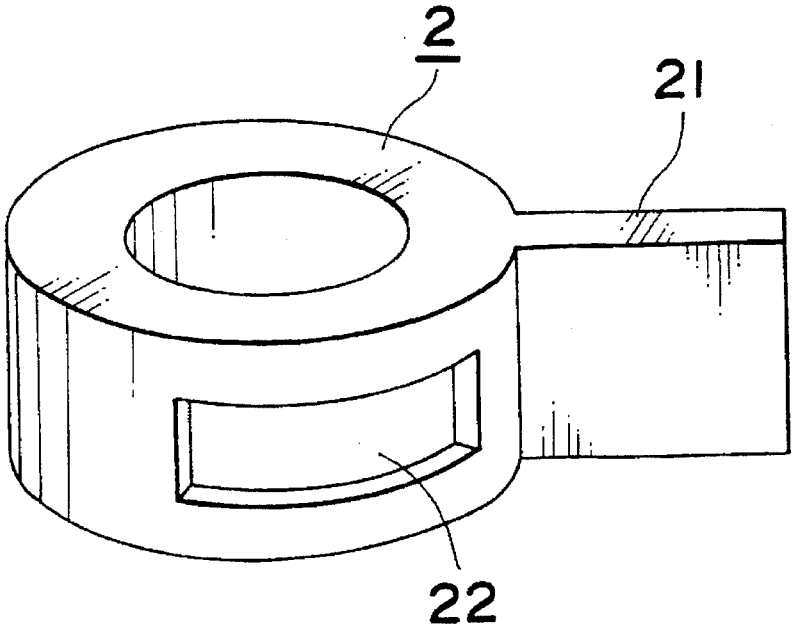
FIG. 4 is a perspective view showing a roller in a third embodiment.

In addition, as in a third embodiment shown in FIG. 4, a cut-off portion 22 may be formed on an axially intermediate portion of a roller 2 so as to be closed to both axial end faces thereof. With such configuration, particularly when the suction port 13 is provided on the cylinder 1, because the suction port 13 is generally formed on an axially intermediate portion of the cylinder 1, the adjustment of the compression capacity can be made exactly while the suction gas resistance to the cut-off portion is held low. Furthermore, when the cut-off portion 22 is formed on the axially intermediate portion of the roller 2 so as to be closed to both axial end faces thereof, because a predetermined thickness can be secured at axial both end faces of the roller 2, the leakage through clearances between axial both end faces of the roller 2 and respective heads can be reduced. Namely, the inner side of the roller 2 is brought into a high pressure state filled with high pressure lubrication oil, etc., while the outer circumferential side of the roller 2 confronting the suction chamber Y is in a low pressure state filled with suction gas. Accordingly, the pressure difference between the inner side and outer side of the roller 2 near the suction port 13 becomes large. Meanwhile, both axial end faces of the roller 2 are in face-to-face contact with the front head and rear head. Therefore, according to the third embodiment, because a predetermined thickness can be secured on the axial both ends of the roller 2, the leakage through clearances between both axial end faces of the roller 2 and the respective heads due to the pressure difference can be reduced, as compared with the case where the cut-off portion 22 is formed over the entire axial length so as to be opened to both axial end faces of the roller 2 as in the first embodiment.

Figure 5:
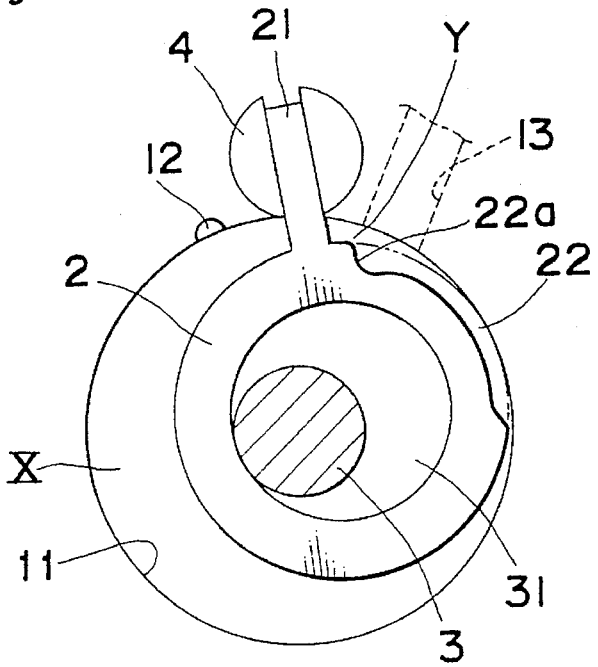
FIG. 5 is a plan view showing the state where a roller is installed in a cylinder chamber in a fourth embodiment of the present invention.
Figure 6:
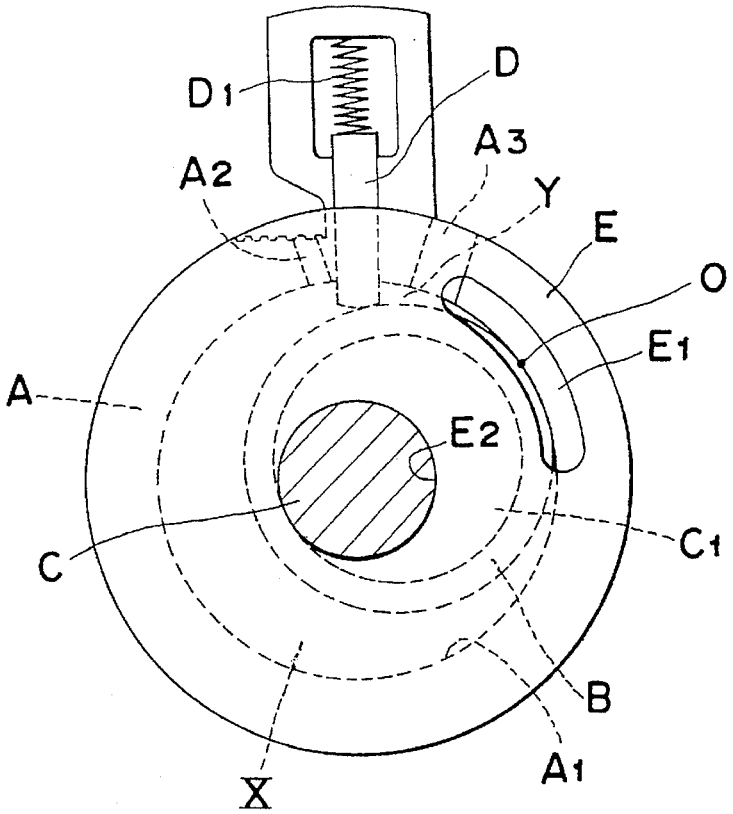
Fig. 6 BACKGROUND ART
FIG. 6 is a plan view showing a conventional example example.
Figure 7:
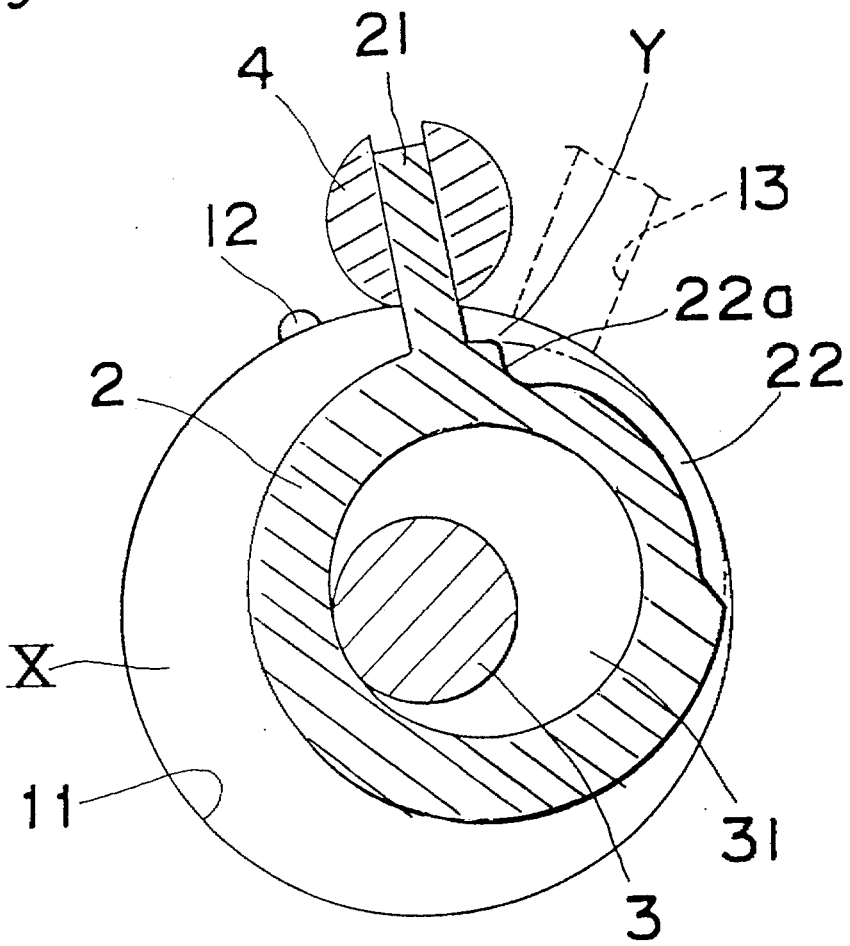
FIG. 7 is a sectional view through the middle of a roller showing a view similar to FIG. 5 with a concave portion in an axially intermediate cut-off portion.

Furthermore as shown in a fourth embodiment in FIG. 5, a concave portion 22*a* may be provided on a position of a cut-off portion 22 confronting a suction port 13 for guiding suction gas introduced from the suction port 13 to the side of the suction chamber Y. By doing so, the suction resistance at the start of suction from the suction port 13 can be further reduced. Further, the suction gas from the suction port 13 can be introduced with less suction resistance and more smoothly toward the forward side in the revolution direction of the suction chamber Y, and can be smoothly bypassed from the suction chamber Y to the compression chamber X via the cut-off portion 22, and thus, the adjustment of the compression capacity can be made exactly. In the embodiment having the concave portion 22*a* of FIG. 5, the cut-off portion 22 can extend completely across the roller 2 as shown in FIGS. 1 and 2 or can be at least one of the cut-off portions 22 at the axial ends of roller 2 as shown in FIG. 3. Also, the concave portion 22*a*, can be provided in the axially intermediate cut-off portion 22 as shown in the embodiment of FIG. 4 and as indicated in the sectional view of FIG. 7.

The swing type rotary compressor according to the present invention is primarily employed in the refrigeration apparatus. The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A swing type rotary compressor which comprises a cylinder having a cylinder chamber inside said cylinder;

a rotatable roller fitted on an eccentric portion of a drive shaft and installed in said cylinder chamber, the roller being rotatable in a revolution direction;

a blade integrally formed on said roller and protruding therefrom to partition said cylinder chamber into a compression chamber and a suction chamber, a suction port being open to the suction chamber over a length in a circumferential direction;

a support body swingably supported on said cylinder and swingably supporting said blade; and a cut-off portion formed on an outer circumference of said roller on a side of the suction chamber with respect to a protruding position from which the blade protrudes and extending from the vicinity of the protruding position forward in the revolution direction over a length in a circumferential direction greater than the length of the suction port in the circumferential direction so as to shift a suction shut-off position for suction gas sucked from said suction port toward a side of the compression chamber.

2. The swing type rotary compressor as described in claim 1, wherein said cut-off portion is formed over an entire axial length of the roller and both axial ends of said cut-off portion are opened to both axial end faces of the roller.

3. The swing type rotary compressor as described in claim 1, wherein said cut-off portion is formed on an axially intermediate portion of the roller so as to be closed to both axial end faces of the roller.

4. The swing type rotary compressor as described in claim 1, wherein the cut-off portion has a length in a circumferential direction which is more than a diameter of the suction port so as to shift the suction shut-off position toward the compression chamber by a length more than the diameter of the suction port.

5. The swing type rotary compressor as described in claim 1, wherein the suction chamber and the compression chamber are in communication through the cut-off portion during a portion of the rotation of the roller.

6. The swing type rotary compressor as described in claim 1, wherein the cut-off portion extends along a circumference of the roller in the revolution direction.

7. The swing type rotary compressor as described in claim 1, wherein a concave portion is provided on said cut-off portion at a position confronting the suction port, the concave portion guides suction gas introduced from the suction port toward the side of the suction chamber.

8. The swing type rotary compressor as described in claim 7, wherein said cut-off portion is formed over an entire axial length of the roller and both axial ends of said cut-off portion are opened to both axial end faces of the roller.

9. The swing type rotary compressor as described in claim 7, wherein said cut-off portion is formed on an axially intermediate portion of the roller so as to be closed to both axial end faces of the roller.

10. The swing type rotary compressor as described in claim 7, wherein the cut-off portion extends in the revolution direction of the roller.

11. The swing type rotary compressor as described in claim 10, wherein the cut-off portion has an upstream side and a downstream side relative to the revolution direction and wherein the concave portion is located at the upstream side of the cut-off portion.

12. The swing type rotary compressor as described in claim 7, wherein the cut-off portion has a first depth and the concave portion has a second maximum depth in the roller and wherein the second maximum depth of the concave portion is greater than the first depth of the cut-off portion.

* * * * *